US006597335B2

(12) United States Patent
Yasunishi et al.

(10) Patent No.: US 6,597,335 B2
(45) **Date of Patent: *Jul. 22, 2003**

(54) LIQUID CRYSTAL DISPLAY DEVICE AND METHOD FOR DRIVING THE SAME

(75) Inventors: Norio Yasunishi, Kitakatsuragi-gun (JP); Satoshi Ueno, Yamatokoriyama (JP)

(73) Assignee: Sharp Kabushiki Kaisha, Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/259,507

(22) Filed: Feb. 26, 1999

(65) Prior Publication Data

US 2002/0097211 A1 Jul. 25, 2002

(30) Foreign Application Priority Data

Feb. 27, 1998 (JP) ..... 10/048022

(51) Int. Cl.[7] ..... G09G 3/36

(52) U.S. Cl. ..... 345/89; 345/691; 345/58; 345/99

(58) Field of Search ..... 345/94, 98, 99, 345/100, 58, 691

(56) References Cited

U.S. PATENT DOCUMENTS

| | | | | |
|---|---|---|---|---|
| 5,206,635 A | * | 4/1993 | Inuzuka et al. | 345/99 |
| 5,670,973 A | * | 9/1997 | Bassetti et al. | 345/58 |
| 5,963,189 A | * | 10/1999 | Ito et al. | 345/100 |
| 6,538,629 B1 | * | 3/2003 | Ito | 345/89 |

FOREIGN PATENT DOCUMENTS

| | | |
|---|---|---|
| JP | 62-183434 | 8/1987 |
| JP | 04-265938 | 9/1992 |
| JP | 05-173507 | 7/1993 |
| JP | 08-241060 | 9/1996 |
| JP | 9-90914 | 4/1997 |

OTHER PUBLICATIONS

Partial electronic translation from Japanese Patent Office website of publication No. JP 09–090914.*

* cited by examiner

*Primary Examiner*—Steven Saras
*Assistant Examiner*—William C. Spencer
(74) *Attorney, Agent, or Firm*—Edwards & Angell, LLP; David G. Conlin; David A. Tucker

(57) ABSTRACT

A method for driving a liquid crystal display device is provided. The device includes a plurality of row electrodes to which a scanning signal is applied: a plurality of column electrodes disposed so as to cross the plurality of row electrodes, to which a display data signal is applied; and a liquid crystal layer interposed between one of the plurality of row electrodes and one of the plurality of column electrodes, for performing a display at a crossing portion of one of the plurality of row electrodes and one of the plurality of column electrodes in response to an effective value of a voltage applied across one of the plurality of row electrodes and one of the plurality of column electrodes, wherein gray-scale display data consisting of a plurality of bits is received, and a voltage of a display data signal selected per bit by a scanning signal is applied during a period in which weights are assigned to bits during one horizontal scanning period and a voltage applying timing is made different at at least one column electrode, whereby a gray-scale display is realized.

6 Claims, 10 Drawing Sheets

A: Lower-order bit data voltage supplying period
B: Higher-order bit data voltage supplying period

PRIOR ART

LIQUID CRYSTAL DISPLAY DEVICE AND METHOD FOR DRIVING THE SAME

BACKGROUND OF THE INVENTION

1. Field of the Invention

The present invention relates to a matrix-type super twisted nematic (STN) liquid crystal display device used for various office automation (OA) equipment such as a personal computer and/or a word processor, a multi-media information terminal, audio video (AV) equipment, game equipment, etc., and a method for driving the same. More specifically, the present invention relates to a liquid crystal display device in which an improved uniform display quality can be obtained, and a method for driving the same.

2. Description of the Related Art

In the above-mentioned STN liquid crystal display device, higher response is known to decrease contrast. Hereinafter, the reason for this and proposed techniques for solving this problem will be described.

In the past, in an STN liquid crystal display device, a line sequential driving system has been adopted. According to this driving system, row electrodes are successively scanned one at a time over one frame period, high scanning pulse is applied to each row electrode only once in one frame period, and in synchronization with this, a data voltage in accordance with display data of each pixel on a row electrode to be scanned is applied to column electrodes.

In a liquidcrystal display device adopting the above-mentioned driving system, a display of mainly a freeze-frame picture is intended. Therefore, such a liquid crystal display device uses liquid crystal with relatively low response. In this case, liquid crystal responds to an effective value of a voltage to be applied, and a practical contrast ratio is obtained. However, when it is attempted to realize high response of the liquid crystal by reducing the viscosity of the liquid crystal and making a liquid crystal layer thinner so as to create a display of a moving picture, according to the line sequential driving system, the liquid crystal responds to a driving waveform itself, without responding to an effective value of a voltage, and the transmittance noticeably fluctuates per frame. This phenomenon is called a frame response phenomenon, which causes a significant decrease in the contrast ratio.

In order to solve the above-mentioned problem, the following driving system is proposed. According to this system, unlike the linear sequential driving system, a plurality of low scanning pulses are applied in one frame, thereby suppressing a frame response phenomenon to prevent the contrast ratio from decreasing. Such a driving system is called a multi-line simultaneous selection driving system, which is characterized in that a plurality of row electrodes are simultaneously scanned by using an orthogonal matrix. Hereinafter, its basic operation will be briefly described.

Input data is subjected to orthogonal transformation by using an orthogonal matrix, and a data voltage based on operational data is applied to a column electrode. In synchronization with this, a scanning voltage based on a column vector of the orthogonal matrix is simultaneously applied to row electrodes to be simultaneously selected. In this way, orthogonal transformation of image data is performed on a liquid crystal panel, and an input image can be reproduced. At this time, depending upon the number of row electrodes be simultaneously selected and the scanning order, the following three driving systems are proposed. The basic principle of each driving system is as described above.

The first driving system is an active addressing system in which all the row electrodes in one screen are simultaneously scanned. This system is disclosed in T. J. Scheffer, et al., SID '92, Digest, p. 228, and Publication for Opposition No. 7-120147.

The second driving system is a sequence addressing system in which a plurality of row electrodes less than all the electrodes in one screen are classified into groups, and each group is sequentially scanned. This driving system enables the circuit size to be smaller, compared with the first driving system. This system is disclosed in T. N. Ruckmongathan et al., Japan Display '92, Digest, p. 65 and Japanese Laid-Open Publication No. 5-46127.

According to the third driving system, one screen is divided into a plurality of blocks in a row direction, and a plurality of row electrodes less than all the electrodes in each block are classified into groups, and each group is sequentially scanned, whereby all the blocks driven (Japanese Laid-Open Publication No. 6-291848). This driving system can reduce memory space, and enables the circuit size to be smaller, compared with the second driving system.

As described above, by adopting a multi-line simultaneous selection driving system in a high-response simple matrix-type liquid crystal display device, the frame response phenomenon is suppressed, and a decrease in the contrast ratio can be prevented.

Furthermore, as a gray-scale system of an STN liquid crystal display device, a pulse width modulation system (PWM system) is known, in which an operation between display data and an orthogonal function is performed per bit, and a data signal voltage with a width corresponding to a weight per bit is applied to a column electrode. This is disclosed in Japanese Laid-Open Publication No. 990914.

However, in the conventional pulse width modulation system, the number of signal changes per horizontal scanning period becomes larger than the case where a gray-scale display is not realized. This increases the frequency of a data voltage signal, so that the amount of induced distortion caused by electrode resistance and liquid crystal capacitance becomes large. As a result, an effective voltage value slightly different from the fundamental effective voltage value is applied to liquid crystal, which leads to a decrease in display quality due to, for example, cross-talk. This will be described with reference to the drawings.

As shown in FIG. 8, a display state of pixels is determined on a liquid crystal panel including 6 pixels in the vertical (row) direction and 2 pixels in the horizontal (column) direction. Each of column electrodes X1 and X2 and row electrodes Y1 to Y6 is determined as shown in this figure. FIG. 9 shows driving waveforms C1C and C2C of the column electrodes X1 and X2 and a driving waveform R1C of the row electrode Y1 in the case where the liquid crystal panel in this state is driven in the conventional manner.

As is understood from FIG. 9, according to the conventional driving system, display data on the column electrode X1 is exactly the same as that on the column electrode X2, so that a data signal represented by the waveform C1C applied to the column electrode X1 becomes exactly the same as a data signal represented by the waveform C2C applied to the column electrode X2. Thus, timing of changes in waveforms and the change directions are exactly the same between the two signals. Therefore, waveform distortion of a scanning voltage represented by the waveform R1C induced by a data voltage becomes relatively large as shown in FIG. 9. Accordingly, a waveform of a voltage actually applied to liquid crystal is largely shifted from an ideal waveform without containing any waveform distortion, and an effective voltage value becomes substantially different from an ideal value.

Thus, considering the case where hundreds of column electrodes are provided, the variation in difference between the effective voltage value and the ideal value becomes large per column electrode according to the conventional driving method, which leads to a decrease in display quality due to, for example, cross-talk.

SUMMARY OF THE INVENTION

A method for driving a liquid crystal display device is provided. The device includes a plurality of row electrodes to which a scanning signal is applied; a plurality of column electrodes disposed so as to cross the plurality of row electrodes, to which a display data signal is applied; and a liquid crystal layer interposed between one of the plurality of row electrodes and one of the plurality of column electrodes, for performing a display at a crossing portion of one of the plurality of row electrodes and one of the plurality of column electrodes in response to an effective value of a voltage applied across one of the plurality of row electrodes and one of the plurality of column electrodes, wherein gray-scale display data consisting of a plurality of bits is received, and a voltage of a display data signal selected per bit by a scanning signal is applied during a period in which weights are assigned to bits during one horizontal scanning period and a voltage applying timing is made different at at least one column electrode, whereby a gray-scale display is realized.

In one embodiment of the present invention, timing of applying a voltage of a display data signal during a period in which weights are assigned to bits during the one horizontal scanning period, and a voltage applying timing is made different at at least one column electrode is adjusted, and a direction of a waveform change of a first display data signal applied to at least one first column electrode at a first timing is opposite to a direction of a waveform change of a second display data signal applied to at least one second column electrode to which a display data signal is applied at a second timing.

In another embodiment of the present invention, timing of applying a voltage of a display data signal during a period in which weights are assigned to bits in the one horizontal scanning period, and timing at which a voltage is applied is made different at at least one column electrode is adjusted, in such a manner that the voltage applying periods of adjacent horizontal scanning periods are connected.

In another embodiment of the present invention, timing of applying a voltage of a display data signal during a period in which weights are assigned to bits in the one horizontal scanning period, and timing at which a voltage is applied is made different at at least one column electrode is adjusted, in such a manner that the voltage applying periods of adjacent horizontal scanning periods are connected.

A liquid crystal display device of the present invention includes a plurality of row electrodes to which a scanning signal is applied; a plurality of column electrodes disposed so as to cross the plurality of row electrodes, to which a display data signal is applied; and a liquid crystal layer interposed between one of the plurality of row electrodes and one of the plurality of column electrodes, for performing a display at a crossing portion of one of the plurality of row electrodes and one of the plurality of column electrodes in response to an effective value of a voltage applied across one of the plurality of row electrodes and one of the plurality of column electrodes. The device further includes: a pulse control portion for receiving gray-scale display data consisting of a plurality of bits, and determining timing at which a voltage of a display data signal selected per bit by a scanning signal by assigning weights to bits in one horizontal scanning period; and a column driver for applying the voltage of the display data signal to at least one column electrode, based on the timing selected by the pulse width control portion.

Hereinafter, the function of the present invention will be described.

According to the present invention, gray-scale display data consisting of a plurality of bits is received, and a display data signal selected per bit by a scanning signal is applied only during a period in which weights are assigned to bits in one horizontal scanning period, and the timing of applying a voltage is made different at each of the column electrodes or at at least one of the column electrodes. Therefore, as represented by (*b*) in FIG. 10, even under the condition of the same gray-scale display data and the same scanning signal, waveforms C1K and C2K of display data signals on different column electrodes change at different times during the same horizontal scanning period. Thus, a degree (amplitude) of distortion of a waveform R1K of a scanning signal induced by the display data signals can be suppressed.

Furthermore, timing of applying a display data signal only during a period in which weights are assigned to bits during one horizontal scanning period and timing of applying a signal is made different per column electrode is adjusted. As represented by (*c*) in FIG. 10, one column electrode to which a display data signal C and another column electrode to which a display data signal C2L is applied are set so as to have opposite directions of waveform change. Thus, when a pulse of one column electrode falls, a pulse of another column electrode rises. Since timing of waveform change and direction of change are different between these two column electrodes, waveform distortion of a scanning signal induced by a data display signal is relatively small and dispersed in terms of time. As a result, a shift of a waveform of a voltage actually applied to liquid crystal from an ideal waveform without any waveform distortion becomes relatively small, and the difference between the effective voltage value and the ideal value does not become so large.

As represented by (*c*) in FIG. 10, timing of applying a display data signal is made opposite between two column electrodes. However, the present invention is not limited thereto. For example, directions of waveform change may be made opposite between at least two column electrodes to which a display data signal is applied at an identical timing and at least two column electrodes at which a display data signal is applied at another identical timing. Furthermore, the present invention is similarly applicable between one column electrode and a plurality of column electrodes. Furthermore, column electrodes to which a display data signal is applied at an identical timing or at another identical timing may be adjacent to each other or separately disposed. Furthermore, even in the case where a plurality of electrodes are supplied with a display data signal at an identical timing and a plurality of electrodes are supplied with a display data signal at another identical timing, respective column electrodes in each column electrode group may be separately disposed.

Furthermore, when the timing of applying a display data signal only during a period in which weights are assigned to bits during one horizontal scanning period, and-the timing of applying a signal is made different per column electrode is adjusted in such a manner that the signal applying periods of adjacent horizontal scanning periods are connected (see (*d*) in FIG. 10), a cycle of waveform change becomes long. Therefore, the number of times waveform distortion of a scanning signal is induced by a data display signal is reduced. As a result, a shift of a waveform of a voltage actually applied to liquid crystal from an ideal waveform without any waveform distortion becomes relatively small, and the difference between the effective voltage value and the ideal value does not become so large. Furthermore, according to this method, a waveform blunting of a data display signal itself is reduced, and a voltage of a data display signal becomes closer to an ideal value, compared with the conventional method.

Furthermore, by combining the relationship represented by (*c*) in FIG. 10 and the relationship represented by (*d*) in FIG. 10, as represented by (*e*) in FIG. 10, the number of times waveform distortion of a scanning signal occurs can be reduced, compared with the case of using the relationship represented by (*b*) in FIG. 10.

Thus, the invention described herein makes possible the advantage of (1) providing a liquid crystal display device in which cross-talk can be decreased; and (2) proving a method for driving the liquid crystal display device.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative embodiments with reference to the drawings.

Figure 1:
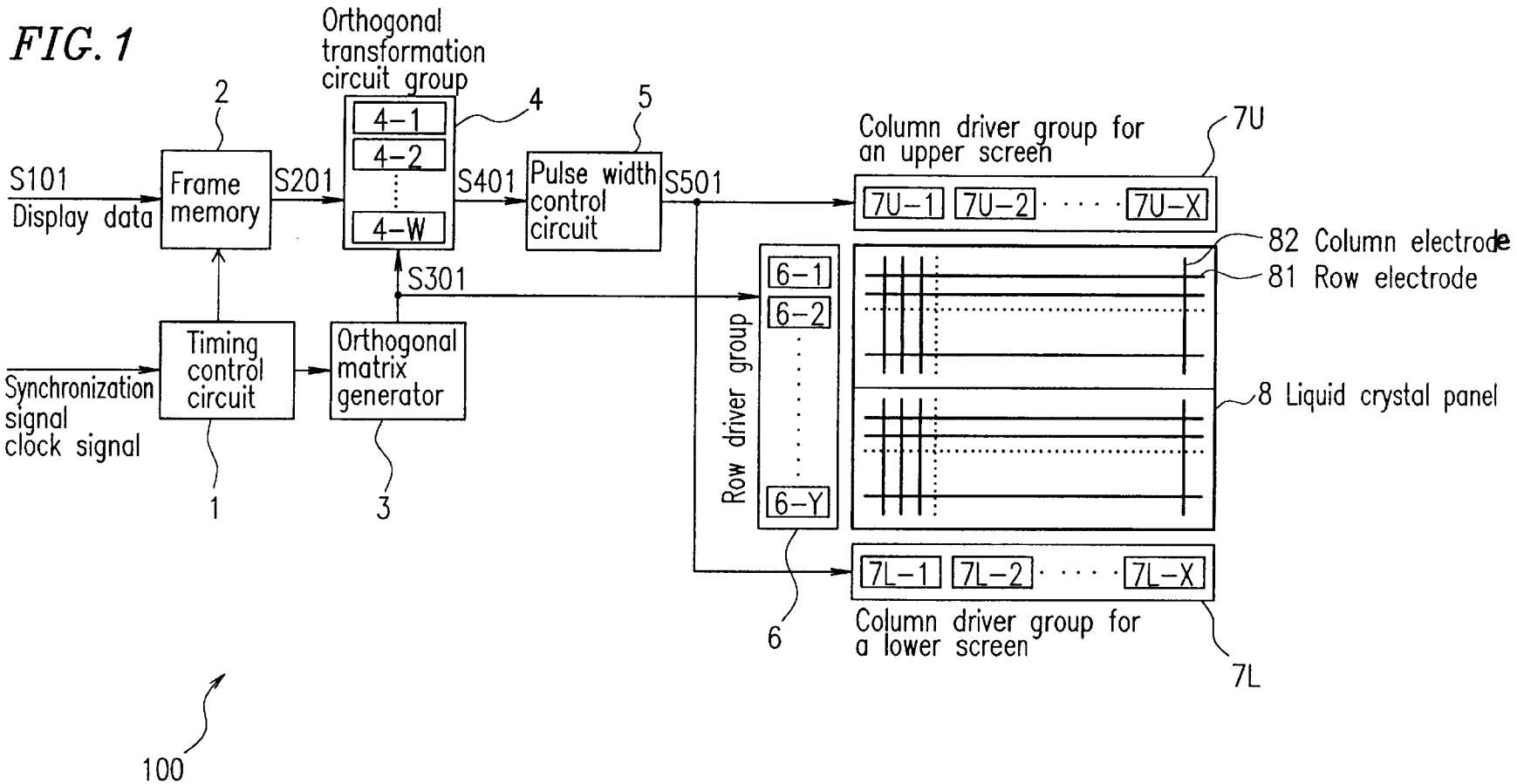
FIG. 1 is a block diagram of a liquid crystal display device according to the present invention.

FIG. 1 schematically shows a liquid crystal display device 100 adopting a multi-line simultaneous selection driving system in one embodiment of the present invention. The liquid crystal display device 100 includes a timing control circuit 1, a frame memory 2, an orthogonal matrix generator 3, an orthogonal transformation circuit group 4, a pulse width control circuit 5, a row driver group 6, a column driver group for an upper screen 7U, a column driver group for a lower screen 7L, and a liquid crystal panel 8.

The timing control circuit 1 controls timing of the entire system of the liquid crystal display device 100.

The frame memory 2 stores multi-bit gray-scale display data with a bit length W. The operation of the frame memory 2 will be described in detail below. Multi-bit gray-scale display data S101 with a bit length W is input to the frame memory 2. The multi-bit grayscale display data S101 is written into the frame memory 2 per row as being input by single scanning. In the present embodiment, one screen (upper screen) is composed of display data of N rows×M columns×W bits. In the liquid crystal display device 100, a multi-line simultaneous selection driving system is adopted, so that L row electrodes 81 are simultaneously selected. Display data S201 of L rows×M columns×W bits corresponding to selected L row electrodes 81 is read. More specifically, among display data of N rows×M columns×W bits of one screen (upper screen), the display data S201 of L rows×M columns×W bits is read per column, and output to the orthogonal transformation circuit group 4.

The orthogonal matrix generator 3 generates an orthogonal matrix with a dimension of L rows×L columns. Based on a timing control signal from the timing control circuit, the orthogonal matrix generator 3 outputs elements S301 in a column direction of the generated orthogonal matrix to the orthogonal transformation circuit group 4 and the row driver group 6 at a time when the display data S201 is input to the orthogonal transformation circuit group 4. A set of elements in a column direction of the generated orthogonal matrix is referred to as a column vector S301. The column vector S301 has a correlationship with the display data S201 read from the frame memory 2. More specifically, the dimensions of the column vector S301 and the display data S201 are L, respectively.

The orthogonal transformation circuit group 4 receives the display data S201 output from the frame memory 2 and the column vector S301 output from the orthogonal matrix generator 3. Herein, the orthogonal transformation circuit group 4 includes orthogonal transformation circuits 4-1, 4-2, . . . , 4-W arranged adjacent to each other so as to correspond to a bit length W of the display data S201. Each orthogonal transformation circuit performs orthogonal transformation of the display data S201 per bit, using the common column vector S301 corresponding to the display data S201. The orthogonal transformation circuit group 4 outputs operational data S401 for all the bits (which is the result obtained by the orthogonal transformation of the display data S201 per bit) to the pulse width control circuit 5.

The pulse width control circuit 5 receives the orthogonal operational data S401 for all the bits output from the orthogonal transformation circuit group 4, converts the operational data S401 into pulse width data signal S501 so as to perform a predetermined gray-scale display, and outputs the pulse width data signal S501 to the column driver group for an upper screen 7U. Simultaneously, the pulse width control circuit 5 also outputs a clock signal GUK and a polarity switching signal POL (see FIG. 4). The clock signal GUK divides one horizontal scanning period into a plurality of periods in accordance with a bit length W. The polarity switching signal POL determines the polarity of a data voltage applied to a column electrode via a column driver.

The row driver group 6 outputs a scanning voltage for L row electrodes to the row electrodes 81 of the liquid crystal panel 8 so that the scanning voltage corresponds to the pulse width data signal S501, based on the column vector S301 of the orthogonal matrix output from the orthogonal matrix generator 3. Similarly, the column driver group for an upper screen 7U supplies a data voltage to a column electrode 82 of the liquid crystal panel 8, based on the pulse width data signal S501 output from the pulse width control circuit 5.

As shown in FIG. 1, the liquid crystal panel 8 is divided into upper and lower screens, each being independently driven (dual scanning type). Each of the upper and lower screens includes N row electrodes 81. The row driver group 6 includes a plurality of row drivers 6-1, 6-2, . . . , 6-Y in accordance with the number N of the row electrodes 81, and successively applies a scanning voltage for L row electrodes to be simultaneously selected to the row electrodes 81, based on the column vector S301 output from the orthogonal matrix generator 3. Similarly, the column driver group for an upper screen 7U includes a plurality of column drivers 7U-1, 7U-2, . . . , 7U-X in accordance with the number M of the column electrodes 82, and supplies a data voltage based on the pulse width data signal S501 output from the pulse width control circuit 5 to the M column electrodes 82 simultaneously. Because of this, on the liquid crystal panel 8, reverse transformation of display data is performed, and reversely transformed display data is displayed.

The liquid crystal panel 8 includes 2×N row electrodes 81 and M column electrodes 82 arranged so as to cross the row electrodes 81. The crossing portions are arranged in a matrix. A liquid crystal layer (not shown) is interposed between the row electrode 81 and the column electrode 82, each crossing portion corresponding to a pixel. The liquid crystal layer at each pixel has its optical state changed in response to an effective value of a driving voltage applied between the row electrode 81 and the column electrode 82, whereby a display is performed. As described above, the liquid crystal panel 8 is divided into upper and lower screens, each being independently driven. Thus, the liquid crystal panel 8 is characterized by a large display capacity.

Figure 8:
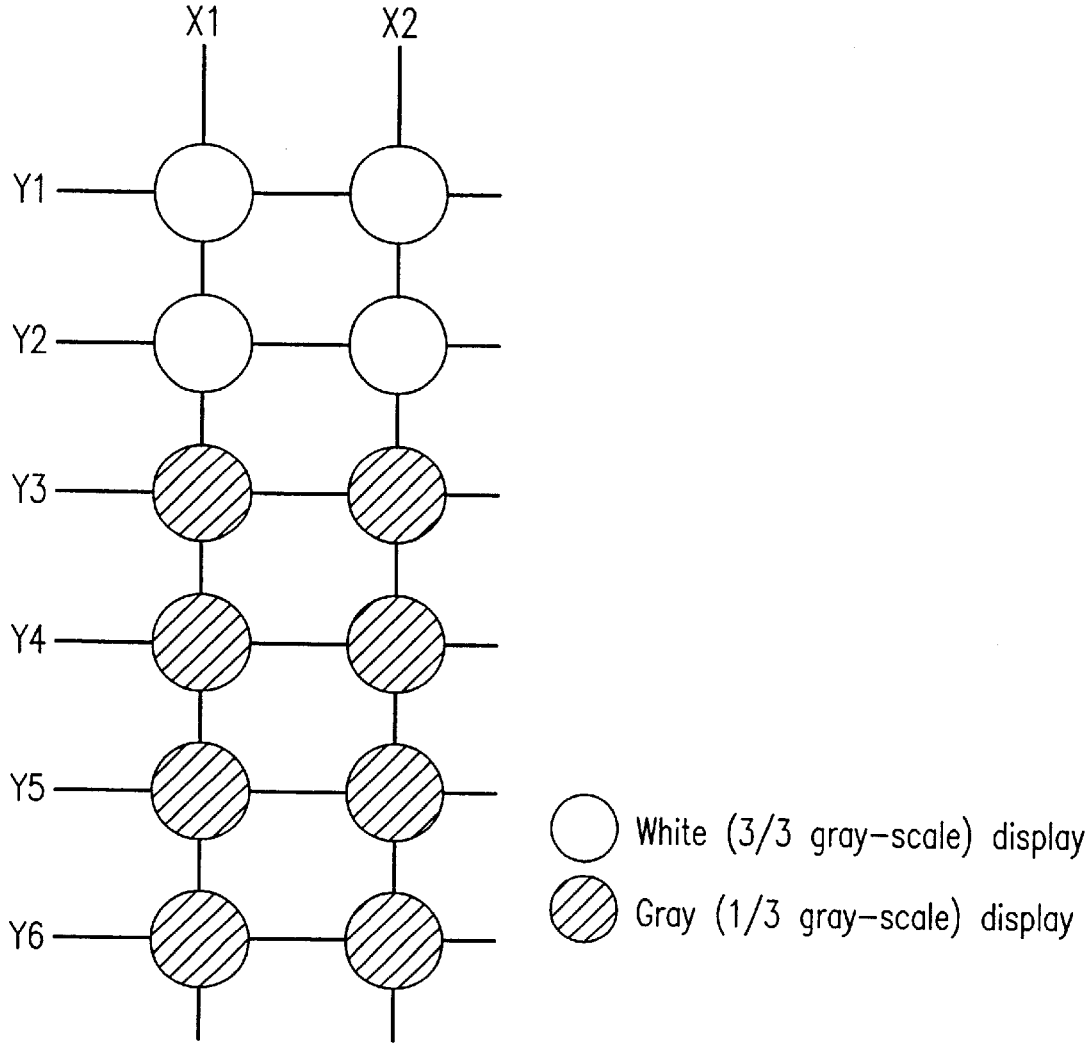
FIG. 8 is a diagram showing a liquid crystal panel composed of 6 row electrodes and 2 column electrodes and its display data.
Figure 9:
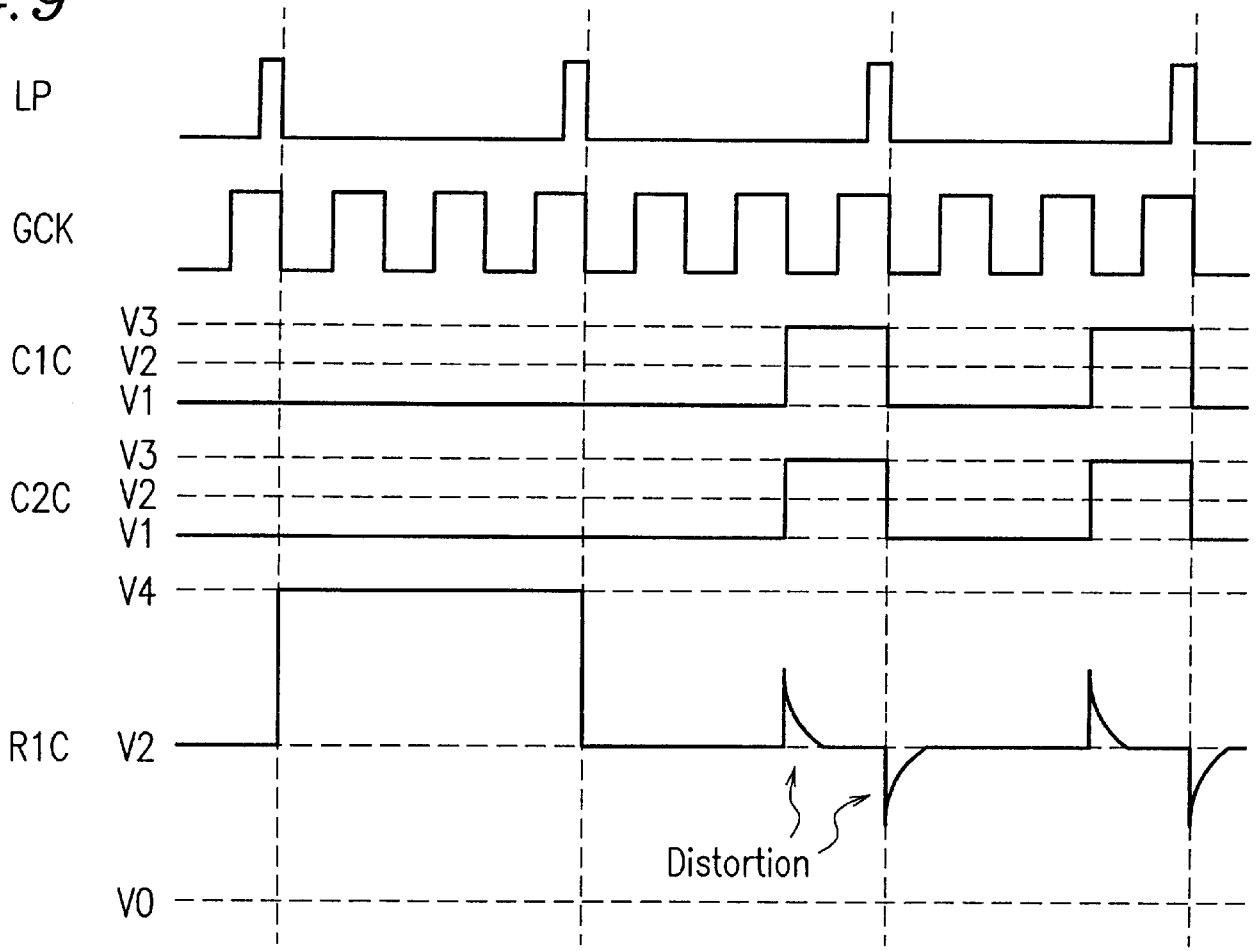
FIG. 9 is a diagram showing waveforms illustrating a conventional driving method for a conventional liquid crystal display.

Each driving circuit will be described by exemplifying the case where two row electrodes are simultaneously selected, gray-scale display data of 2 bit length is input, and a 4 gray-scale display is performed in the liquid crystal display device 100. Herein, for simplicity, a liquid crystal panel of 6 rows and 2 columns as shown in FIG. 8 is used. As described above, an actual liquid crystal panel includes a much larger number of row electrodes and column electrodes, one screen including N row electrodes and M column electrodes.

Figure 2:
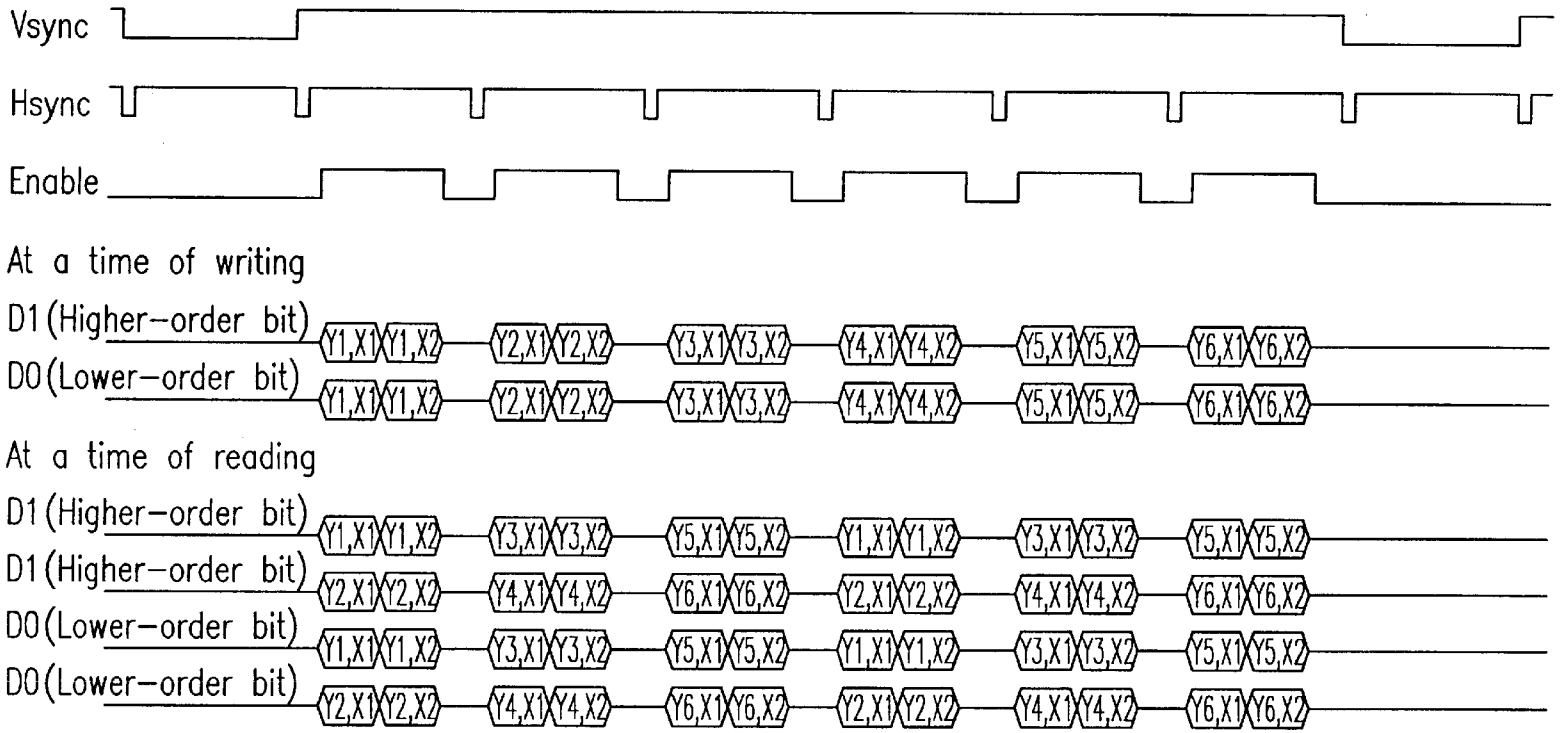
FIG. 2 is a timing diagram illustrating control of a frame memory.

FIG. 2 is a timing chart showing control of the operation of the frame memory 2. In FIG. 2, (*a*) represents a $V_{sync}$ signal, (*b*) represents a $H_{sync}$ signal, (*c*) represents an Enable signal, (*d*) represents a write operation, and (*e*) represents a read operation. In FIG. 2, the $V_{sync}$ signal and the $H_{sync}$ signal respectively represent a vertical synchronization signal and a horizontal synchronization signal input together with the gray-scale display data S101. One period of the $V_{sync}$ signal is referred to as one vertical scanning period, and one period of the $H_{sync}$ signal is referred to as one horizontal scanning period.

As represented by (*d*), in the case where 6 rows of gray-scale display data is input, an enable signal (high level when data is effective) representing an effective period of display data becomes a high level only in 6 contiguous horizontal scanning periods during one vertical scanning period. In the frame memory 2, gray-scale display data of 2 bit length is written as being input by single scanning, based on the Enable signal.

In FIG. 2, (*e*) represents a read operation of gray-scale display data from the frame memory 2. Here, simultaneously selected two rows of gray-scale display data of 2 bit length is read from the frame memory 2 twice per frame period and output to the orthogonal transformation circuit group 4.

Figure 3:
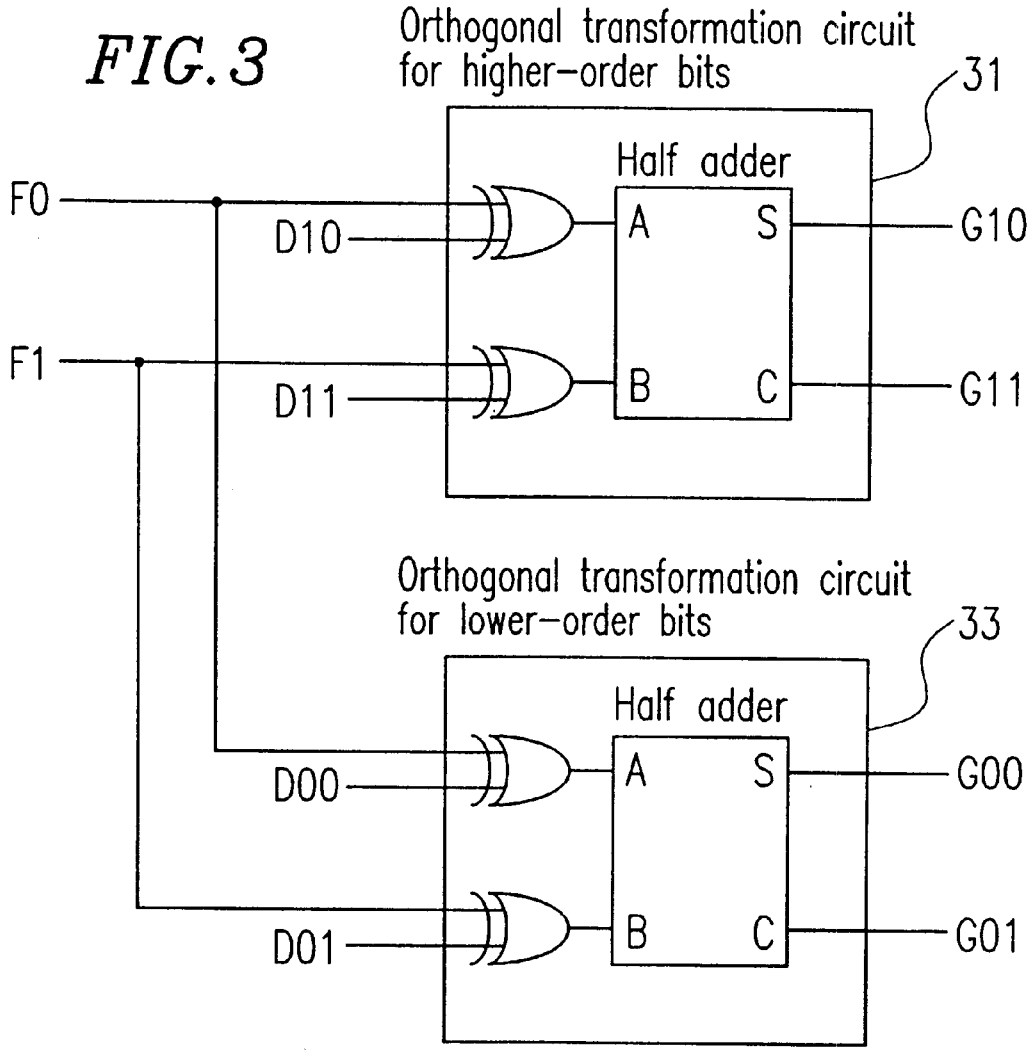
FIG. 3 is a block diagram of an orthogonal transformation circuit group.

As shown in FIG. 3, the orthogonal transformation circuit group 4 is composed of orthogonal transformation circuits 31 and 33 for higher-order bits and lower-order bits. The respective orthogonal transformation circuits perform orthogonal transformation of the gray-scale display data S201 of 2 bit length read from the frame memory 2 per bit, using elements F0 and F1 in a column direction of the orthogonal function output from the orthogonal function generator 3. Herein, the higher-order bit display data is D10 and D11, and the lower-order bit display data is D00 and D01. The operational data after being subjected to the orthogonal transformation corresponds to G10, G11 and G00, G01, respectively.

Figure 4:
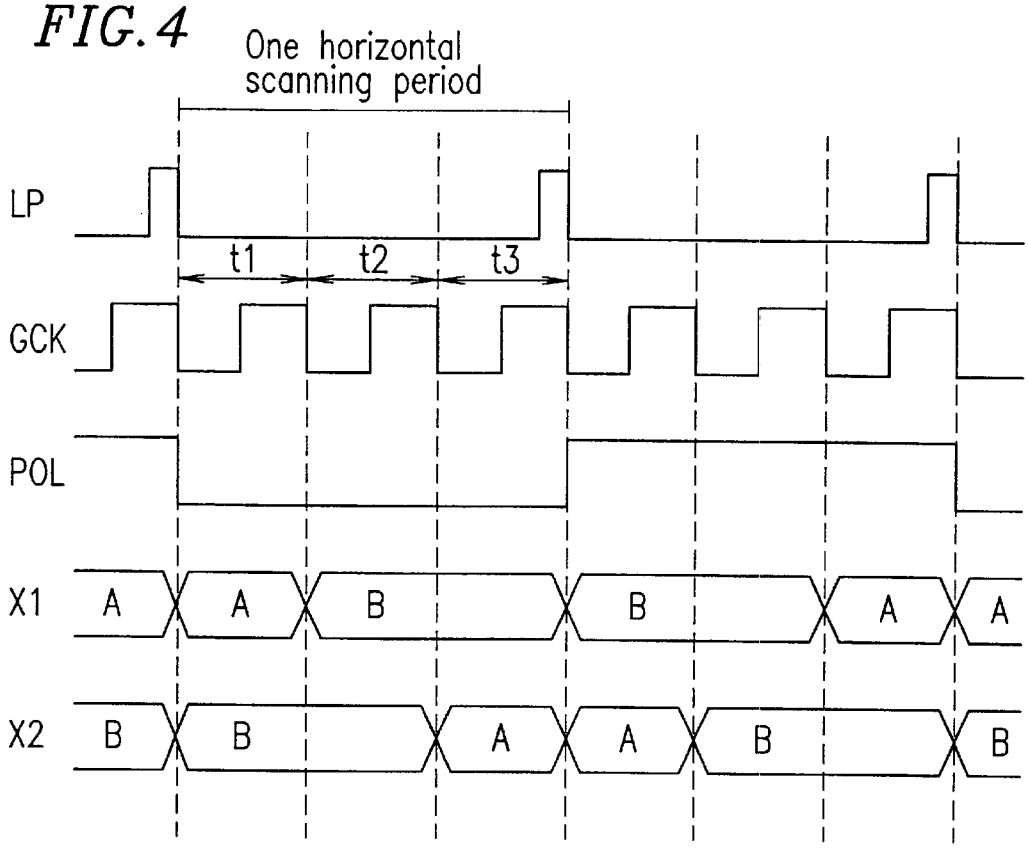
FIG. 4 is a timing diagram illustrating control of a pulse width modulation system according to the present invention.

FIG. 4 is a timing chart illustrating an operation of the pulse width control circuit 5. A clock signal GCK divides one horizontal scanning period into a plurality of periods in accordance with a bit length W. In the case of gray-scale display data of 2 bit length, weights are assigned to the higher-order bits and lower-order bits during a data voltage supplying period. The ratio between a higher-order bit data voltage supplying period B and a lower-order bit data voltage supplying period A is 2:1. Therefore, the clock signal GCK divides one horizontal scanning period into three periods t1 to t3. The higher-order bit data voltage supplying period B and the lower-order bit data voltage supplying period A are appropriately allocated per column electrode. For a first column electrode X1, t1 is assigned to the lower-order bit data voltage supplying period A, and t2 and t3 are assigned to the higher-order bit data voltage supplying period B. For a second column electrode X2, t1 and t2 are assigned to the higher-order bit data voltage supplying period B, and t3 is assigned to the lower-order bit data voltage supplying period A.

The polarity switching signal POL signal is a control signal which switches the above-mentioned sequence of the higher-order bit and lower-order bit data voltage supplying periods per horizontal scanning period. In the present embodiment, the data voltage supplying sequences are alternately switched between the first column electrode X1 and the second column electrode X2 per horizontal scanning period.

Figure 5:
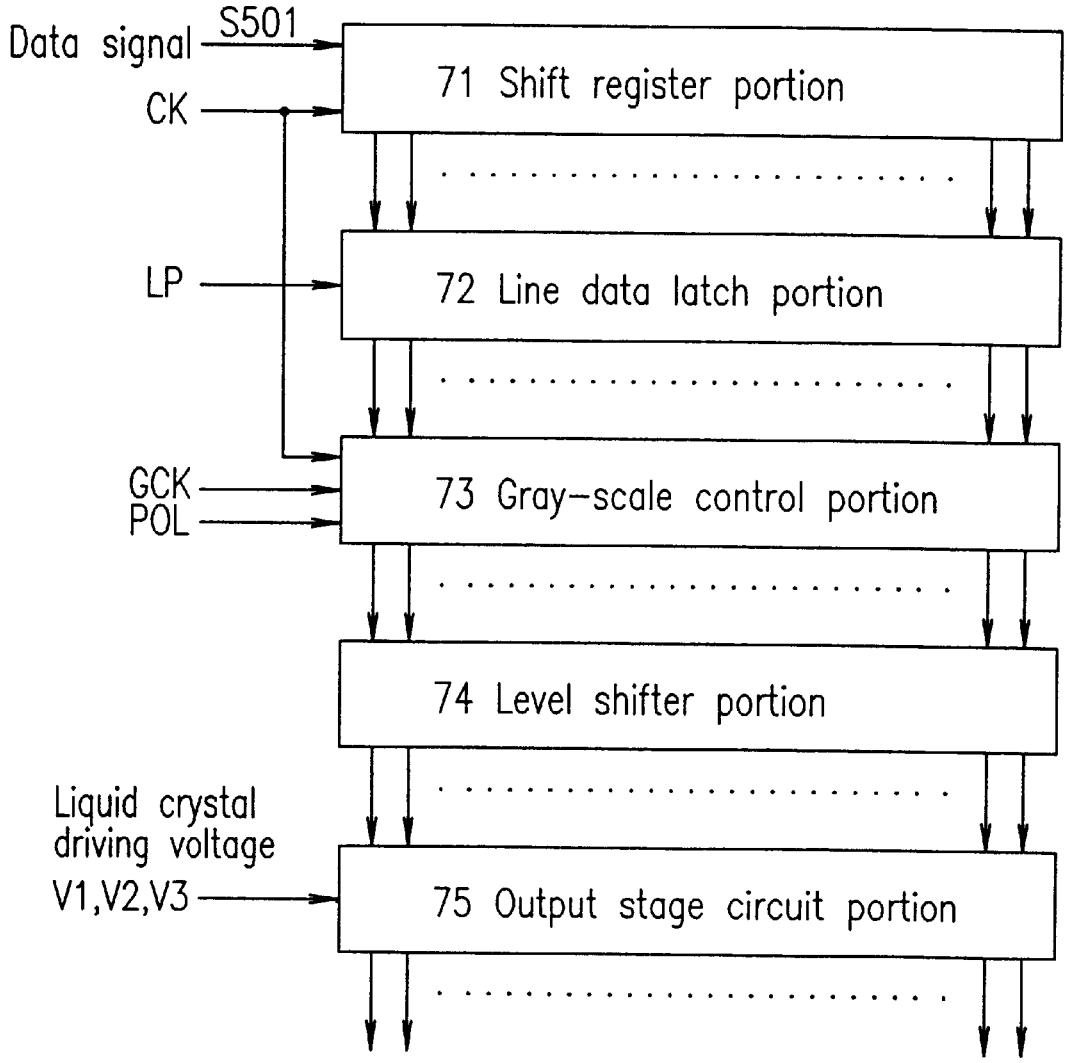
FIG. 5 is a block diagram of a column driver according to the present invention.
Figure 6:
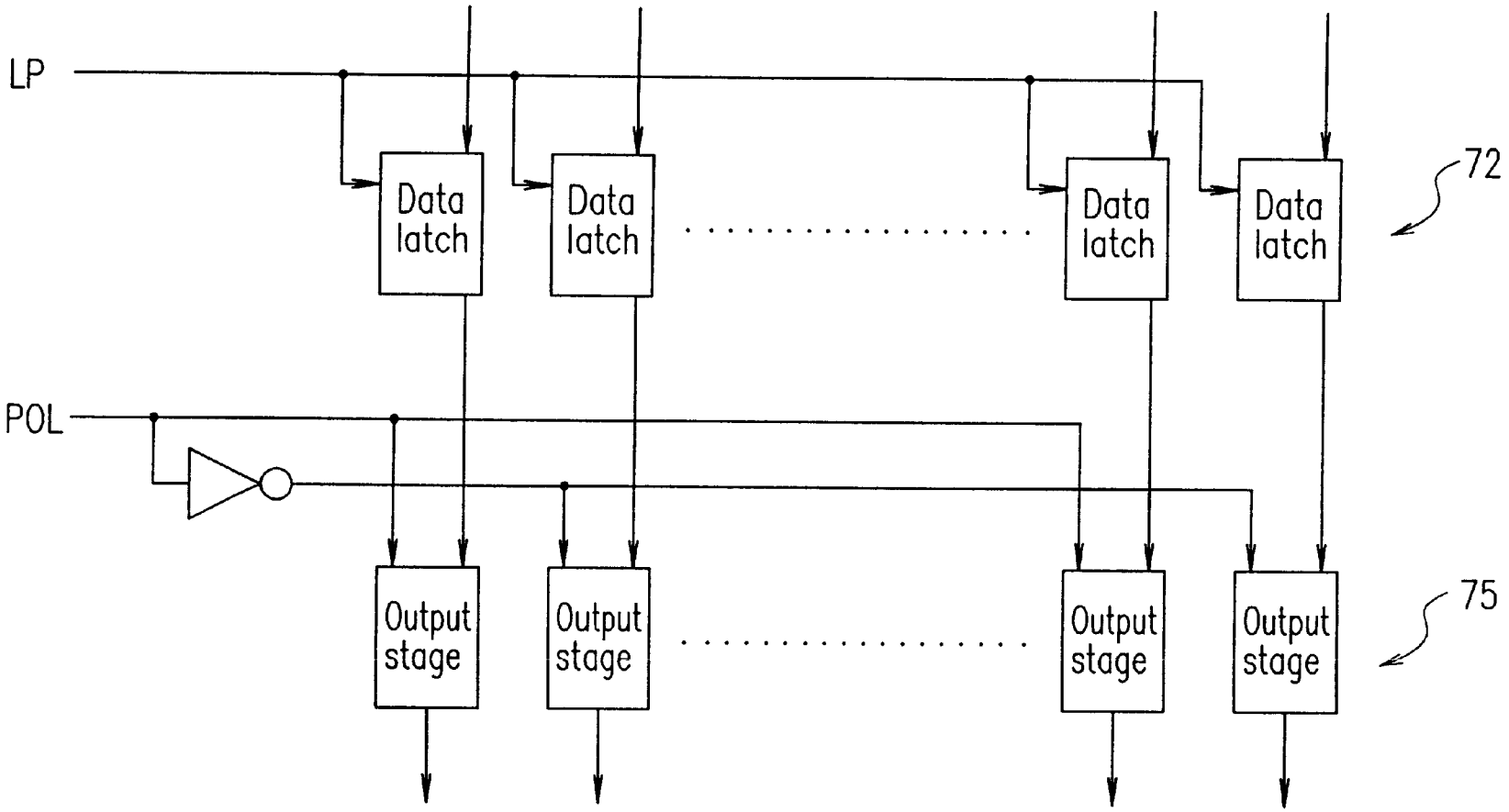
FIG. 6 is a block diagram of a liquid crystal output stage circuit of a column driver according to the present invention.

FIG. 5 is a block diagram showing a configuration of the column driver. The column driver includes a shift register portion 71, a line data latch portion 72, a gray-scale control portion 73, a level shifter portion 74, and an output stage circuit portion 75. FIG. 6 shows signal processing content of the column driver.

The pulse width data signal S501 output from the pulse width control circuit 5 is successively accumulated as one row of data in the line data latch portion 72 through the shift register portion 71. The line data latch portion 72 outputs the accumulated data to the gray-scale control portion 73 at a latch timing of a latch clock signal LP.

The above-mentioned clock signal GCK and the polarity switching signal POL are input to the gray-scale control portion 73. The level shifter portion 74 generates a control signal which selects a data voltage to be applied to the column electrode 82. The output stage circuit portion 75 selects either of liquid crystal driving voltages V1, V2, and V3 to be input, and supplies it to the column electrode 82.

Figure 7:
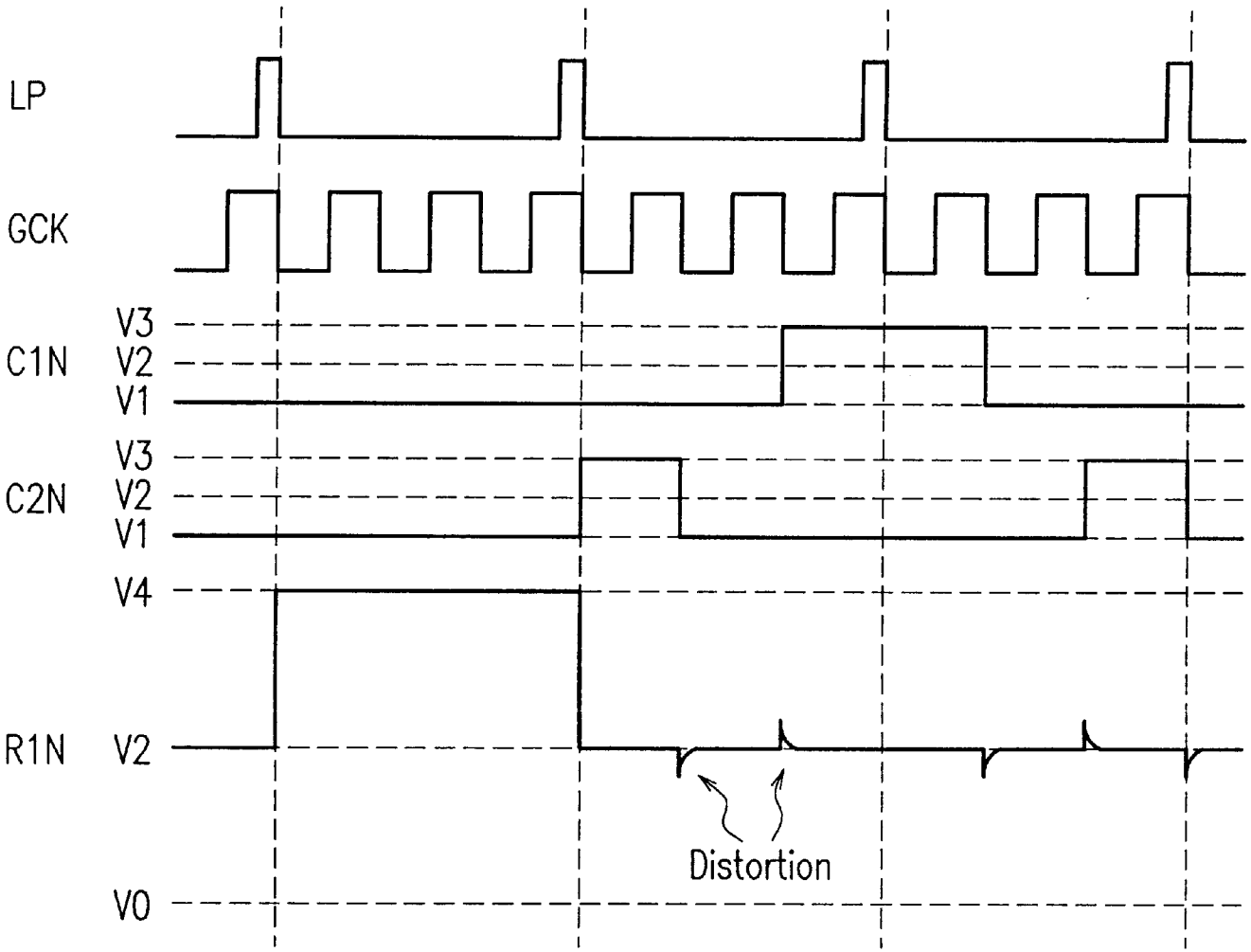
FIG. 7 is a diagram showing an example of driving waveforms according to the present invention.
Figure 10:
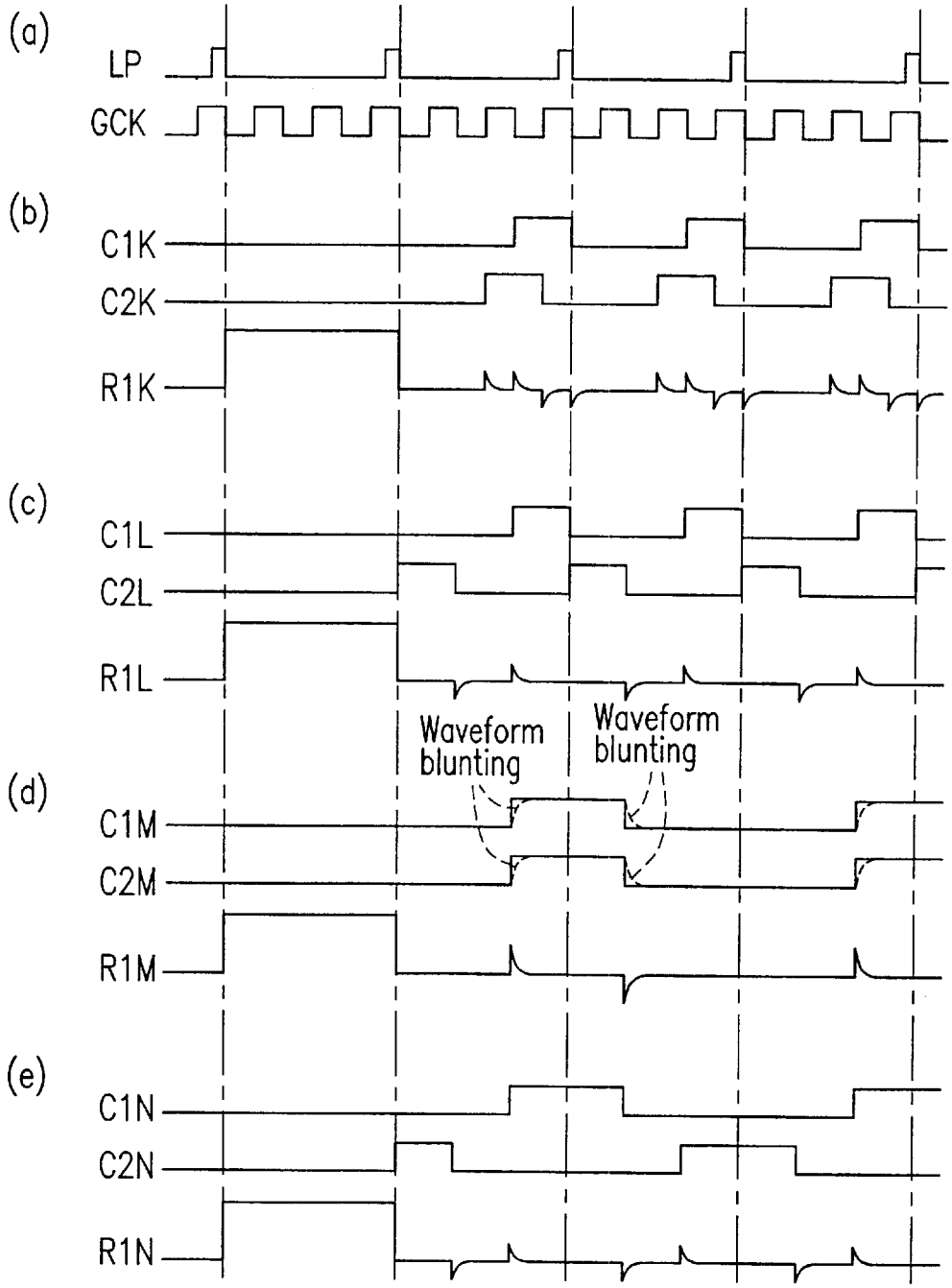
FIG. 10 is a diagram showing an example of waveforms illustrating a driving method of the present invention.

FIG. 7 shows an example of a driving waveform in the present embodiment. In the same way as in the waveform represented by (*d*) in FIG. 10, FIG. 7 shows the case of driving by using the combination of the relationship represented by (*c*) in FIG. 10 and the relationship represented by (*d*) in FIG. 10. Herein, X1 and X2 represent column electrodes (see FIG. 8), C1N and C2N represent driving waveforms applied to the respective column electrodes X1 and X2. Y1 to Y6 represent row electrodes (see FIG. 8), and R1N represents a driving waveform applied to the row electrode Y1.

As is understood from FIG. 7, although display data on the column electrode X1 is the same as that on the column electrode X2, a data signal voltage on the column electrode X1 is different from that on the column electrode X2 as represented by C1N and C2N in FIG. 7. Thus, the timing of changes in waveforms and directions of changes in waveforms are different. Therefore, distortion of the driving waveform RIN induced by a data voltage is relatively small, and dispersed in terms of time. Accordingly, the shift of a voltage waveform actually applied to liquid crystal from an ideal waveform without any distortion becomes relatively small, and the difference between an effective voltage value and an ideal value does not become substantial.

A driving method of the present invention has been described above, using a liquid crystal panel of 6 rows and 2 columns as shown in FIG. 8. However, the driving method is similarly performed in a liquid crystal panel in which the number of row electrodes and the number of column electrodes are much larger than the above-mentioned example, and one screen is composed of N rows and M columns. More specifically, even in the case of performing the same gray-scale display, a data signal is supplied at different timings per column electrode (for example, a first data signal (e.g., the signal C1N in FIG. 7) is applied to the odd-number column electrode, and a second data signal (e.g., the signal C2N in FIG. 7) is applied to the even-number column electrode. In this way, only distortion of a waveform induced into a scanning signal from a data signal can be suppressed, and the variation in difference between the effective voltage value and the ideal value per column electrode can be reduced, which enables driving to be performed without reducing display quality.

An experiment was conducted in the liquid crystal display device 100 (FIG. 1) constructed as described above, using a color liquid crystal panel in which the number N of row electrodes in each of upper and lower screens is 300, the number M of column electrodes is 2400(=800×RGB), a threshold voltage is 2.3 volts, and a response speed ($\tau r+\tau d$) 150 ms. The number of row electrodes to be simultaneously driven was two. As a result, cross-talk caused by induced distortion can be substantially reduced, whereby a 4096 color display (each color containing 4 bits) was obtained.

Furthermore, by combining thinning out of a frame and a dither system with the present invention, 17,660,000 color display (each color containing 8 bits) with extremely less cross-talk and flickering can be realized.

In the above-mentioned embodiment, the case of combining the method represented by (*c*) in FIG. 10 and the method represented by (*d*) in FIG. 10 has been described. However, the present invention is not limited thereto. It is appreciated that driving can be performed by using the method represented by (*b*) in FIG. 10, the method represented by (*c*) in FIG. 10, or the method represented by (*d*) in FIG. 10.

The present invention has been applied to a liquid crystal display device adopting a multi-line simultaneous selection driving system. However, the present invention is also effectively applicable to a liquid crystal display device adopting a conventional line sequential driving system.

As described above, according to the present invention, by suitably setting the timing of supplying a data signal, a shift of an effective voltage from an ideal value due to the induction from a data signal to a scanning signal can be eliminated, whereby cross-talk which degrades display quality can be reduced.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for driving a liquid crystal display device having a plurality of row electrodes to which a scanning signal is applied;

a plurality of column electrodes to each of which a display data signal is applied, said plurality of column electrodes being disposed in crossing relationship with said plurality of row electrodes; and a liquid crystal layer interposed between at least one of the plurality of row electrodes and at least one of the plurality of column electrodes for performing a display at a crossing portion of said at least one of the plurality of row electrodes and said at least one of the plurality of column electrodes in response to an effective value of a voltage applied across said at least one of the plurality of row electrodes and said at least one of the plurality of column electrodes;

the method comprising the steps of:

generating the scanning signal from an output of an orthogonal matrix generator;

simultaneously driving at least two of said plurality of row electrodes;

receiving gray-scale display data including upper bits and lower bits in a predetermined weighted relationship to one another;

varying a combined magnitude of the scanning signal and the display data signal so as to control an effective value of the voltage applied across said at least one of the plurality of row electrodes and said at least one of the plurality of column electrodes by, (i) distributing one period of applying a first display data voltage corresponding to said upper bits and another period of applying a second display data voltage corresponding to said lower bits during one horizontal scanning period according to the relative weights of the upper bits and the lower bits in the gray-scale display data; and (ii) varying the order of the one period of applying a first display data voltage corresponding to said upper bits and the another period of applying a second display data voltage corresponding to said lower bits during one horizontal scanning period between one of said plurality of column electrodes and another one of said plurality of column electrodes, whereby a shift of an actual voltage waveform applied to the liquid crystal relative to an ideal waveform for application to the liquid crystal is small due to a reduction in distortion of the scanning signal induced by the display data voltage.

2. A method for driving a liquid crystal display device according to claim 1, wherein the direction of a waveform variation of a first display data signal applied to said one of the column electrodes at a first timing is opposite to the direction of a waveform variation of a second display data signal applied to said another of the column electrodes at a second timing.

3. A liquid crystal display device comprising:

an orthogonal matrix generator for providing a scanning signal based on a generated orthogonal matrix;

a plurality of row electrodes, at least two of said plurality of row electrodes having said scanning signal simultaneously applied thereto;

a plurality of column electrodes disposed in crossing relationship to the plurality of row electrodes and having display data signals applied respectively thereto;

a liquid crystal layer interposed between at least one of the plurality of row electrodes and at least one of the plurality of column electrodes, said liquid crystal layer being adapted for performing a display at a crossing portion of said at least one of the plurality of row electrodes and said at least one of the plurality of column electrodes in response to an effective value based on a combined magnitude of the scanning signal and the one of said display data signals respectively applied across said at least one of the plurality of row electrodes and said at least one of the plurality of column electrodes;

a pulse width control portion for receiving gray-scale display data including upper bits and lower bits in weighted relationship to one another, and for controlling a display data signal application period corresponding to said upper bits and another display data signal application period corresponding to said lower bits during one horizontal scanning period; and a column driver for applying display data signals to said column electrodes and for varying the order of the display data signal application period corresponding to said lower bits and the display data signal application period corresponding to said upper bits controlled to one of said plurality of column electrodes and to another of said plurality of column electrodes, whereby a shift of an actual voltage waveform applied to the liquid crystal relative to the ideal waveform for application thereto is small due to a reduction in distortion of the scanning signal induced by the display data signal.

4. A method for driving a liquid crystal display device for use in reducing a distortion in a scanning signal and for use in reducing a shift in a waveform applied to a liquid crystal of the liquid crystal display comprising the steps of:

receiving gray-scale display data including upper bits and lower bits in a preselected weighted relationship to one another;

generating a scanning signal based on an output of an orthogonal matrix generator;

generating a display data signal based on the output of the orthogonal matrix generator and the received gray-scale display data;

distributing one period of applying a first display data signal corresponding to said upper bits and another period of applying a second display data signal corresponding to said lower bits during one horizontal scanning period according to the relative weights of the upper bits and the lower bits in the gray-scale display data; and varying the order of the one period of applying a first display data signal corresponding to said upper bits and the another period of applying a second display data signal corresponding to said lower bits during one horizontal scanning period between one of said plurality of column electrodes and another one of said plurality of column electrodes, to reduce a distortion in a scanning signal and a shift in a waveform applied to a liquid crystal of the liquid crystal display.

5. A method for driving a liquid crystal display device, comprising a plurality of row electrodes to which a scanning signal is applied; a plurality of column electrodes disposed so as to cross the plurality of row electrodes, to which a display signal is applied; and a liquid crystal layer interposed between one of the plurality of row electrodes and one of the plurality of column electrodes, for performing a display at a crossing portion of one of the plurality of row electrodes and one of the plurality of column electrodes in response to an effective value of a voltage applied across one of the plurality of row electrodes and one of the plurality of column electrodes, said method comprising the steps of:

receiving gray-scale display data of n bit length, including upper bits and lower bits in a predetermined weighted relationship to one another;

determining a period for applying a first display data voltage corresponding to said upper bits according to the relative weights of said upper bits and said lower bits in said gray-scale display data; and offsetting the start of the period of applying a first display data voltage corresponding to said upper bits between one of said plurality of column electrodes and another of said plurality of column electrodes, by a period of time which is less than $1/(2^n-1)$ of a horizontal scanning period.

6. A liquid crystal display device, comprising:

a plurality of row electrodes to which a scanning signal is applied;

a plurality of column electrodes disposed so as to cross the plurality of row electrodes, to which a display data signal is applied;

a liquid crystal layer interposed between one of said plurality of row electrodes and one of said plurality of column electrodes, for performing a display at a crossing portion of one of said plurality of row electrodes and one of said plurality of column electrodes in response to an effective value of a voltage applied across one of the plurality of row electrodes and one of the plurality of column electrodes;

a pulse control portion for receiving gray-scale display data consisting of a plurality of n bits, for determining a period for applying a first display data voltage corresponding to said upper bits according to the relative weights of said upper bits and said lower bits in said gray-scale display data, and for offsetting the start of the period of applying a first display data voltage corresponding to said upper bits between one of said plurality of column electrodes and another one of said column electrodes by a period of time which is less than $1/(2^n-1)$ of a horizontal signal period; and a column driver for applying the voltage of the display data signal to at least one of said plurality of column electrodes and another one of said plurality of column electrodes based on the timing selected by said pulse width control portion.

* * * * *